United States Patent [19]

Anderson

[11] Patent Number: 4,481,966

[45] Date of Patent: Nov. 13, 1984

[54] WATERLINE FREEZE PROTECTION SYSTEM

[75] Inventor: Raymond Anderson, Langley, Canada

[73] Assignee: Brag Systems Canada Ltd., Langley, Canada

[21] Appl. No.: 512,066

[22] Filed: Jul. 8, 1983

[30] Foreign Application Priority Data

Feb. 11, 1983 [CA] Canada ..... 421374

[51] Int. Cl.[3] ..... E03B 7/12; F16L 55/00

[52] U.S. Cl. ..... 137/59; 137/565; 417/40

[58] Field of Search ..... 137/59, 60, 61, 62, 137/79, 565, 392, 429; 417/40

[56] References Cited

U.S. PATENT DOCUMENTS

| | | | |
|---|---|---|---|
| 1,607,246 | 11/1926 | Durdin, Jr. | 417/40 |
| 2,739,662 | 3/1956 | Sofia | 417/40 |
| 2,791,964 | 5/1957 | Reeve | 417/40 |
| 3,091,184 | 5/1963 | Wood | 417/40 |
| 3,149,571 | 9/1964 | Myers | 417/40 |
| 3,366,063 | 1/1968 | Cottrell | 417/40 |

*Primary Examiner*—George L. Walton
*Attorney, Agent, or Firm*—Lawrence I. Field

[57] ABSTRACT

A water line freeze protection system consisting of first and second branch pipes extending from a water service pipe, a water holding tank, a metering orifice between the first branch pipe and the holding tank, a pump and a check valve between the holding tank and the second branch pipe, the check valve permitting flow of water only in the direction from the pump to the second branch pipe, a float and switch secured to the holding tank to activate the pump at an upper water level and deactivate the pump at a lower water level, and an overflow pipe from the holding tank to pass water from the holding tank into a drain when the pump is none operational.

1 Claim, 1 Drawing Figure

WATERLINE FREEZE PROTECTION SYSTEM

This invention relates to a waterline freeze protection system.

BACKGROUND OF INVENTION

In cold climates where temperatures below 0° C. are encountered for weeks or months at a time, it is necessary to provide protection for fresh-water pipes from a water main so that they do not freeze. There are numerous methods presently utilized, however they are all either complicated or expensive to operate.

One method utilizes two pipes from a water main with a circulating pump for continuously circulating water through the pipes and the unit water system. This system requires the additional cost of installing a second pipe and a pump and the pipe may still freeze if there is a power failure or if the pump fails.

Another method utilized is to heat trace the entire length of the service pipe from the water main with an electrical heating tape, and then insulating the water pipes. Here again there is an inherent high installation cost and if there is a break in the electrical heating tape or if there is a power supply failure, there is a great likelihood that water in the service pipe will freeze.

There is therefore a great need for a system for use in northern climates to prevent water in a service pipe to a residence or the like from freezing which is not dependent upon a power supply so that when the power supply fails the system will still operate to prevent water from freezing in the service pipe.

SUMMARY OF THE INVENTION

This invention relates to a system which utilizes one service pipe from a water main and an orifice through which water is continually metered into a holding tank. When the holding tank is full, a pump is activated to empty water from the holding tank and pass it back into the service pipe and hence into the water main or into the unit being serviced. A fail-safe feature is built into the system in that if the power supply fails, water from the holding tank when it becomes full and passes into the sewer system.

DETAILED DESCRIPTION OF PREFERRED EMBODIMENTS

Figure 1:
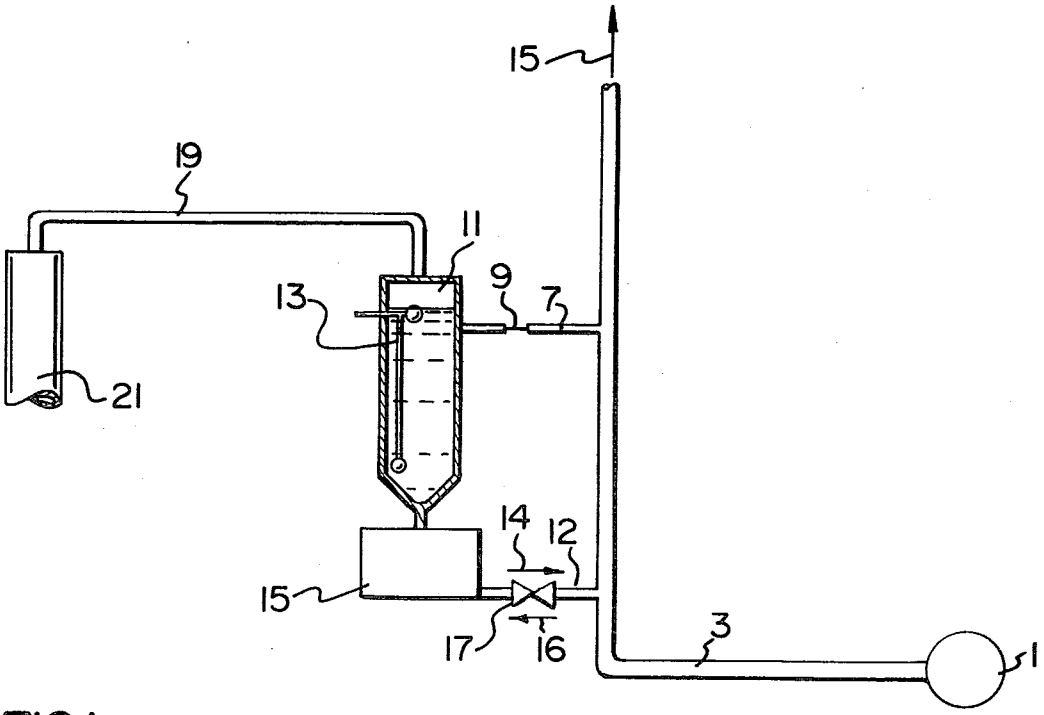
FIG. 1 shows a diagrammatic view of an embodiment of the water line freeze protection system of this invention.

Referring to FIG. 1 a water main 1 has fresh water continually flowing through it from the main water supply. A unit service pipe 3 is secured to the water main and feeds fresh water to the unit as shown by arrow 5. There will often be still water in the service pipe 3 when water is not being extracted in the unit being serviced, and in order to prevent freezing of this water in pipe 3 there is provided a first branch pipe 7 having an orifice 9 which preferentially will pass approximately one liter per minute of water therethrough. The metered water then passes into a holding tank 11 which includes a known type of float system 13 which switches on a pump 15 when the water reaches an upper level in the holding tank 11 and switches off the pump 15 when the water is extracted to a lower level in the holding tank. When the water reaches the upper preset level in the holding tank 11, the pump 15 is activated and pumps water in the direction of the arrow 14 through a second branch pipe 12 back into the service pipe 3 and back into the water main if water is not being drawn in the unit. Water is prevented from flowing in the direction of the arrow 16 by a check valve 17. If there is a failure in the pump 15 due to a malfunction or a power supply failure, when the water fills the holding tank 11 it will overflow through the overflow pipe 19 into a sewer line 21 so that there will be a metered flow of water through service pipe 3.

It has been found that with an orifice which passes approximately one liter per minute of water, by using a 30 liter capacity tank the tank would be pumped down to its lower water level approximately every 30 minutes, and the pump size can preferably be such that the pump down will take approximately one minute.

The orifice, holding tank, and pump, or at least the orifice are preferably positioned at the most remote part of the unit piping such that the water being metered continually through orifice 9 passes through the longest length possible of pipe within the unit to pick up heat from the unit. This further assists in preventing the possibility of freeze-up in the service pipe 3.

Also, as the water is continually flowing in the service pipe 3 and in at least part of the unit piping, the water within the housing piping is generally quite cool and cold water for drinking can be obtained from a tap within the unit almost immediately without the necessity of running the tap until cold water is obtained hence avoiding wastage of water which generally occurs with heated water systems.

Furthermore, the system described in this application is fail-safe and is relatively inexpensive to install and operate compared with the known systems and is therefore commercially acceptable.

I claim:

1. A water line freeze protection system consisting of first and second branch pipes separately extending from a water service pipe, a water holding tank, a metering orifice between the first branch pipe and the holding tank, a pump and a check valve between the holding tank and the second branch pipe, the check valve being between the pump and the service pipe, the check valve permitting flow of water only in the direction from the pump to the second branch pipe, a float and switch secured to the holding tank to activate the pump at an upper water level and deactivate the pump at a lower water level, said freeze protection system being achieved by the continuous flow of water through a loop consisting of a portion of the service pipe and through said first branch pipe, said metering orifice, said holding tank, said pump, said check valve and returning to said service pipe portion through said second branch pipe during the operation of said pump to create a heat effect in said service pipe portion and an overflow pipe from the holding tank to pass water from the holding tank into a drain when the pump is nonoperational.

* * * * *